US007323294B2

(12) United States Patent
van Boxtel et al.

(10) Patent No.: US 7,323,294 B2
(45) Date of Patent: Jan. 29, 2008

(54) PHOTOGRAPHIC COLOUR MATERIAL CONTAINING A RESORCINOL DERIVATIVE AS BLACK COUPLER

(75) Inventors: Huibert Albertus van Boxtel, Tilburg (NL); Akira Kase, Tilburg (NL); Yasuo Iwasa, Tilburg (NL); Yuzo Toda, Goirle (NL)

(73) Assignee: Fuji Photo Film Co., Ltd., Kanagawa (JP)

( * ) Notice: Subject to any disclaimer, the term of this patent is extended or adjusted under 35 U.S.C. 154(b) by 37 days.

(21) Appl. No.: 11/247,960

(22) Filed: Oct. 11, 2005

(65) Prior Publication Data

US 2006/0084014 A1 Apr. 20, 2006

Related U.S. Application Data

(63) Continuation of application No. PCT/NL2004/000246, filed on Apr. 13, 2004.

(30) Foreign Application Priority Data

Apr. 11, 2003 (EP) ..... 03076067

(51) Int. Cl.

| | |
|---|---|
| ***G03C 5/18*** | (2006.01) |
| ***G03C 1/005*** | (2006.01) |
| ***G03C 1/494*** | (2006.01) |
| ***G03C 1/08*** | (2006.01) |

(52) U.S. Cl. ..... 430/401; 430/402; 430/543; 430/564; 430/565

(58) Field of Classification Search ..... 430/401, 430/402, 564, 565, 543
See application file for complete search history.

(56) References Cited

U.S. PATENT DOCUMENTS

| | | | | |
|---|---|---|---|---|
| 2,322,037 A | | 6/1943 | Lindquist | 95/9 |
| 4,126,461 A | | 11/1978 | Pupo et al. | 96/50 R |
| 4,387,158 A | | 6/1983 | Postle | 430/364 |
| 4,429,035 A | * | 1/1984 | Kato et al. | 430/402 |
| 4,439,518 A | | 3/1984 | Postle | 430/402 |
| 4,830,954 A | | 5/1989 | Matejec | 430/505 |
| 5,356,760 A | * | 10/1994 | Okumura et al. | 430/402 |
| 5,821,039 A | | 10/1998 | Leone et al. | 430/376 |
| 6,103,460 A | | 8/2000 | Takahashi et al. | 430/546 |

FOREIGN PATENT DOCUMENTS

| | | |
|---|---|---|
| DE | 28 18 363 | 11/1978 |
| EP | 0 069 066 | 1/1983 |
| EP | 0 568 777 | 11/1993 |
| EP | 0 816 918 | 1/1998 |
| JP | 53-133432 | 11/1978 |
| JP | 55-059462 | 5/1980 |
| JP | 58-010737 | 1/1983 |
| JP | 58-140739 | 8/1983 |
| JP | 63-095441 | 4/1988 |
| JP | 05-232647 | 5/1993 |
| JP | 10-333296 | 12/1998 |

OTHER PUBLICATIONS

James, "Characteristic Curves," *The Theory of the Photographic Process*, 4th ed. Ch. 17, pp. 501-509 (1977).
Lutter, "The Under-Exposure Period of the Characteristic Curve," *Trans. Faraday Soc.*, 19:340-348 (1923).
English abstract of DE 28 18 363, Nov. 1978.
English abstract of EP 0 069 066, Jan. 1983.
English abstract of JP 53-133432, Nov. 1978.
English abstract of JP 55-059462, May 1980.
English abstract of JP 58-010737, Jan. 1983.
English abstract of JP 58-140739, Aug. 1983.
English abstract of JP 63-095441, Apr. 1988.
English abstract of JP 05-232647, May 1993.
English abstract of JP 10-333296, Dec. 1998.

* cited by examiner

*Primary Examiner*—Geraldina Visconti
(74) *Attorney, Agent, or Firm*—Banner & Witcoff, Ltd.

(57) ABSTRACT

A color photographic material is disclosed comprising a black image forming coupler substituted in the 2, 4 and/or 6 position shown by formula (I) or formula (II), where in LINK represents a divalent linking group, BALL represents a group that prevents the coupler from diffusing away from the layer containing it. X and Y each represent a hydrogen atom or a coupling-off group capable of being released upon an oxidative coupling reaction with a developing agent. The material has a good color reproduction and excellent light stability.

11 Claims, 1 Drawing Sheet

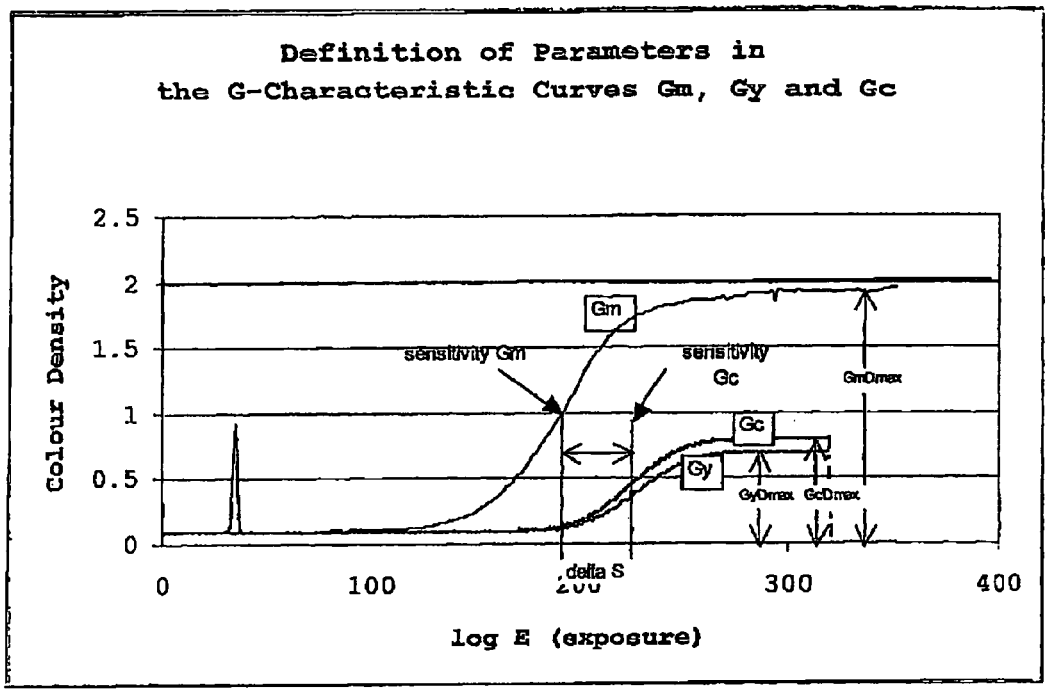
Definition of Parameters in
the G-Characteristic Curves Gm, Gy and Gc
Colour Density
2.5
2
1.5
1
0.5
0
0
100
200
300
400
log E (exposure)
Gm
sensitivity Gm
sensitivity
Gc
GmDmax
Gc
Gy
GyDmax
GcDmax
delta S

PHOTOGRAPHIC COLOUR MATERIAL CONTAINING A RESORCINOL DERIVATIVE AS BLACK COUPLER

This application is a continuation of PCT application No. PCT/NL2004/000246, designating the United States and filed Apr. 13, 2004; which claims the benefit of the filing date of European application No. 03076067.2, filed Apr. 11, 2003; both of which are hereby incorporated herein by reference.

FIELD OF THE INVENTION

The invention relates to silver halide photographic materials comprising certain coupler compounds.

BACKGROUND OF THE INVENTION

Conventional silver halide photographic materials for colour prints have at least one yellow dye forming layer, at least one magenta dye forming layer and at least one cyan dye forming layer. After image wise exposure through a colour negative and subsequent processing in a colour developing process a colour print is obtained reproducing the colours of the originally photographed scene. Recently digital systems like Fuji's Frontier® system are used to produce such prints.

The extent to which the original colours can be reproduced is determined to a large degree by the choice of colour forming molecules or couplers and is referred to as the colour space of the set of couplers.

Conventional coupler sets are deficient in, reproducing neutral grey or black densities. Also deep colours such as shadow details in the original scene require high densities in the colour print in order to be reproduced naturally. conventional coupler sets have difficulty in reaching such high densities.

JP-B-83010737 describes a photographic material in which a low sensitive black dye forming layer using an aminophenol coupler is located under the other light sensitive layers to improve neutral grey densities.

JP-A-6395441 ads a black colour forming layer to a silver halide negative material to improve the overall sensitivity. The black colour forming layer contains a set of yellow magenta and cyan couplers or an aminophenol coupler.

JP-A-53133432 attempts to improve neutral and black densities by adding a black dye forming an aminophenol coupler into or adjacent to a silver halide emulsion layer. However, aminophenol black couplers have an inferior blue/black colour.

Photographic materials for black-and-white prints which can be processed in a colour developing process are described in, for example, JP-A10333296 and JP 05-232647. A black colour forming coupler is used. These comprise aminophenols and resorcinols. U.S. Pat. No. 5,821,039 describes the use of a 5-carbamoyl-resorcinol black coupler as an attempt obtain a black-and-white photographic material which has an improved black colour. Use of resorcinol couplers for colour photographic materials is not disclosed or suggested in these patents.

Although in the state of the art the importance of the stability of yellow, magenta and cyan dyes formed from their respective couplers has been recognized, and has been the subject of many improvements, the documents remain silent with respect to the stability of the dye formed from black couplers.

FIG. 1: Set of characteristic curves of a photographic product comprising a green light sensitive layer and a black layer.

SUMMARY OF THE INVENTION

It is the object of this invention to provide a colour photographic material with an excellent stability under prolonged exposure to light, but also in the dark, in various conditions of humidity and temperature. A further object of this invention is to provide a colour photographic material with good colour reproducibility. It is also an object of the invention to provide an economically attractive colour photographic material.

Surprisingly, it was found that all of these objectives were met by a colour photographic material (viz. a material comprising at least one of yellow, magenta and cyan coupler) comprising a black coupler, which is a resorcinol compound that is substituted in the 2, 4 and/or 6 position.

DESCRIPTION OF THE INVENTION

The invention is directed to colour photographic materials with excellent colour reproduction. The invention is especially directed to colour photographic materials in which colour reproduction is improved by forming a black coloured dye in addition to a yellow and/or magenta and/or cyan dye.

The present invention is based on the surprising insight that only colour photographic materials, comprising resorcinol black couplers in which the linked ballasting group is substituted in the 2, 4 and/or 6 position, remain stable when subjected to prolonged light exposure or dark storage, under various temperature and humidity conditions after colour development.

Black couplers are couplers which after development in a colour developer process form a dye with a broad absorption spectrum resulting in a mainly black appearance. Black aminophenol couplers are black couplers as described above having basically an aminophenol structure. Black resorcinol couplers are black couplers as described above having basically a 1,3-dihydroxybenzene structure.

Black couplers react with oxidised colour developers like, for example, oxidised para phenylene diamines to yield a black dye. A black dye is a dye which has about equal absorption in blue, green and red regions of the spectrum. When the adsorption distribution over the spectrum is unbalanced the colour is not pure black. In such a case the black coupler is said to be, for example, bluish black.

Addition of a black coupler to cinematic film or colour negative materials, or simulating a black coupler by adding a mixture of cyan, yellow and magenta couplers is described in JP-A 55059462 and U.S. Pat. No. 4,830,954. These publications are silent with respect to application of a black coupler in a photographic material having a reflective base material. DE-A-28 18 363, suggests the use of aminophenol black couplers for colour photographic materials.

Black resorcinol couplers are well known in black and white photographic materials where they are applied for their more neutral black colour when compared to aminophenol type black couplers. Examples of such publications are U.S. Pat. Nos. 4,429,035, 5,356,760, 5,821,039, 4,387,158 and 4,438,518. Although the latter two publications mention colour development processes, both of these documents, as well as the other cited documents are directed to black and white photographic materials only and are absolutely silent with respect to applying the couplers in colour photographic materials. Use of these resorcinol couplers in colour photographic materials is thus not disclosed nor suggested in these documents.

Black resorcinol couplers are well known in black and white photographic materials where they are applied for their more neutral black colour when compared to aminophenol type black couplers. Examples of such publications are U.S. Pat. Nos. 4,429,035, 5,356,760, 5,821,039, 4,387,158 and 4,439,518. Although the latter two publications mention colour development processes, both of these documents, as well as the other cited documents are directed to black and white photographic materials only and are absolutely silent with respect to applying the couplers in colour photographic materials. Use of these resorcinol couplers in colour photographic materials. Use of these resorcinol couplers in colour photographic materials is thus not disclosed nor suggested in these documents.

Said black resorcinol coupler is preferably represented by the general formula (I), more preferably by formula (II):

(I)

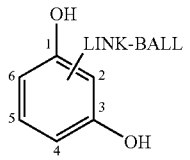

(II)

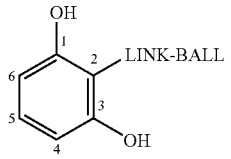

wherein BALL represents a group which prevents the coupler from diffusing away from the layer containing it. LINK represents a divalent linking group which serves to join the resorcinol moiety to the BALL moiety and can be attached to carbon atoms labelled 2, 4 or 6 of the six-membered ring shown in formula (I, the 2-position being preferred. X and Y in formula (II) represent a hydrogen atom or any group capable of being released upon an oxidative coupling reaction with a developing agent. Suitable LINK and BALL groups are described in, for example, U.S. Pat. Nos. 4,126,461 and 5,821,039. The particular coupler chosen will affect the hue of the resultant dye image and its light and heat stability and accordingly certain LINK groups are preferred over others since they yield more neutral grey images, more image density and better light and heat stability of those images than others. Such preferred LINK groups are:

—COR, —$SO_2$R, —COOR, —NHCOR, —CONHR, —CON(R)$_2$, —$COSO_2$R, —NHCONHR, —$NHSO_2$R and —NHR (R=BALL moiety)

wherein the left hand side of the LINK group is attached to the resorcinol moiety at positions 2, 4, or 6 but most preferably to position 2.

The BALL group can be any group which is bulky enough to keep the coupler from migrating or wandering from the location in the element in which it is incorporated. Just like in the case of the LINK group, certain BALL groups are preferred over others because they have shown to yield better light and heat stability and more neutral grey tones. Accordingly, preferred BALL groups include:

(a) phenyl and naphthyl groups which may be unsubstituted or substituted with such groups as hydroxy, halo (such as chloro, bromo and iodo), sulfonyl halide, nitro, cyano, amino, alkyl of 1 to 20 carbon atoms, including substituted alkyl (such as haloalkyl, arylalkyl), or alkyl groups substituted with aryl groups, alkoxy of 1 to 20 carbon atoms, alkylthio of 1 to 20 carbon atoms, and alkoxycarbonyl of 1 to 20 carbon atoms (b) alkyl groups of 3 to 20 carbon atoms; and (c) heterocyclic groups containing a ring system of 5 to 10 atoms, and containing hetero atoms such as oxygen, nitrogen and sulphur, e.g., furyl, quinolyl, thienyl, etc. The BALL moiety can also be a polymeric moiety, or it can be one of the above BALL moieties to which is attached a second resorcinol-LINK-group so as to form a bis-compound symmetrical or unsymmetrical around the BALL moiety. Non-diffusibility of the resorcinol couplers is enhanced when the alkoxycarbonyl groups which comprise the BALL moiety contain 8 or more carbon atoms, e.g., 8 to 20 atoms.

Preferred non-diffusible resorcinol couplers useful in the elements of this invention can be represented by formula (I) wherein LINK and BALL are the preferred groups such as defined above.

Particularly preferred are those non-diffusible resorcinol couplers having the above structural formula for which the LINK-BALL moieties are attached to position 2 of the resorcinol moiety and wherein LINK is a —CONH— group, and BALL is an alkyl group of 3 to 20 carbon atoms or a phenyl group substituted with an alkyl group of 1 to 20 carbon atoms or substituted with a substituted or unsubstituted alkylaryl group or with an alkoxy group of 1 to 20 carbon atoms.

X and Y in formula (II) each represent a hydrogen atom or a coupling-off group capable of being released upon oxidative coupling reaction with a developing agent and practical examples of the coupling-off group include a halogen atom (e.g., chlorine, bromine, etc.); an unsubstituted or substituted alkoxy group (e.g., ethoxy, n-dodecyloxy, methoxyethylcarbamoylmethoxy, carboxymethoxy, methylsulfonamidoethoxy, ethylsulfonylethoxy, etc.); an alkylthio group (e.g., ethylthio, n-butylthio, n-decylthio, 3-chloropropylthio, etc.); an arylthio group (e.g., phenylthio, 4-methoxyphenylthio, 2,5-dihydroxy-3-di-n-butylcarbamoylphenyl, naphthylthio, etc.); an acyloxy group (e.g., acetoxy, tetradecanoyloxy, benzoyloxy, etc.); a sulfonyloxy group (e.g., methanesulfonyloxy, dodecanesulfonyloxy, etc.); an acylamino group (e.g., dichloroacetylamino, heptafluorobutyrylamino, etc.); a sulfonylamino group (e.g., methanesulfonylamino, dodecanesulfonylamino, benzenesulfonylamino, etc.); an alkyloxycarbonyloxy group (e.g., ethoxycarbonyloxy, benzyloxycarbonyloxy, etc.); an aryloxycarbonyloxy group (e.g., phenoxycarbonyloxy, etc.); and an imido group (e.g., succinimido, hydantoinyl, etc.).

Representative couplers which are useful in the practice of the invention are:

S-1

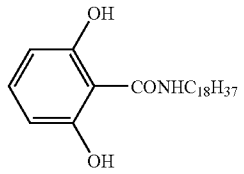

-continued

S-2

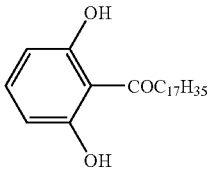

S-3

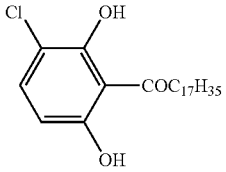

S-4

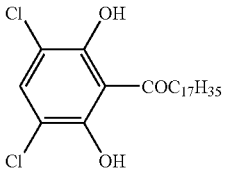

S-5

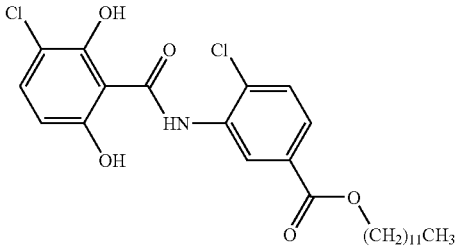

S-6

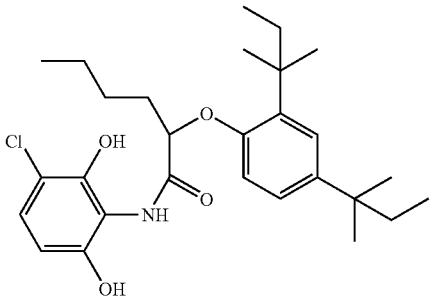

S-7

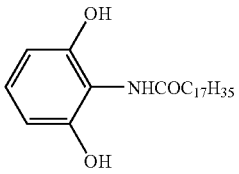

S-8

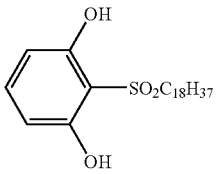

-continued

S-9

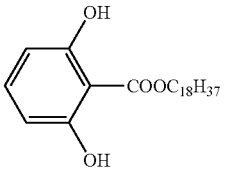

S-10

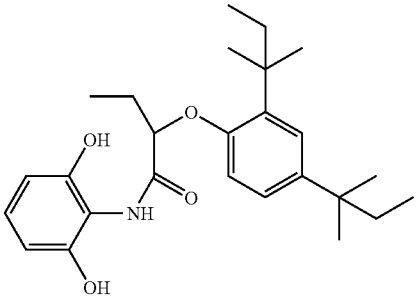

In the prior art there is no reference to the light stability of dyes derived from black couplers. As is shown in Example 1, the light stability of black aminophenol couplers is poor. To our surprise we found that dyes from black resorcinol couplers which are substituted in the 2, 4 and/or 6 position are stable when exposed to light. Especially a dye from a black resorcinol coupler which is substituted with a —CONH— group in the 2 position gives a very stable black dye as shown in Example 1. Dyes having no substitution in the 2, 4 or 6 position do not show this remarkable stability, as is also shown in Example 1. This example also shows that dyes obtained from black resorcinol couplers of the invention have a superior black colour compared to those obtained from black aminophenol couplers or resorcinol couplers not substituted in the 2, 4 and/or 6 position.

The present invention now makes it possible to produce colour photographic products with excellent colour reproducibility comprising black couplers that satisfy the high standards of stability that are demanded from contemporary photographic products.

In one embodiment a black coupler according the invention is added to at least one silver halide layer. The black coupler can be added as a mixture with yellow, magenta and/or cyan coupler(s) in a high boiling organic solvent which is dispersed in the silver halide layer or the black coupler and the yellow, magenta or cyan coupler(s) are dissolved in separate high boiling solvents and subsequently dispersed. The high boiling organic solvent is a solvent which is in essence immiscible with water and is dispersed in a aqueous gelatine phase to forms a discontinuous phase consisting of so called oil-droplets to obtain a so-called oil-in-water emulsion. High boiling solvent or oils suitable for dissolving couplers are well known in the art. Examples of such high-boiling solvents or oils are described in, for example, U.S. Pat. No. 2,322,027. Specific examples of the high boiling organic solvents are described in U.S. Pat. No. 6,103,460 column 62-63. Other dispersion methods like a latex dispersion method or a polymer dispersion method comprising emulsification together with an oil-soluble polymer as described in, for example, *Research Disclosure*, February 1995, Item 37038 can be employed. Concentration and/or reactivity of the black coupler may easily be optimised by the skilled person, so that colour reproduction is not impaired. In practice this means that in a yellow, magenta or cyan characteristic curve, at a density of less than about 0.7, preferably of less than about 1.0, most preferably of less than 1.5, substantially no black colour is formed.

This is also the case for pure red, green or blue colours which are formed from combinations of yellow, magenta and cyan densities. Also less pure colours are formed which combine yellow, magenta and cyan densities.

For example, a black coupler can be added to the green sensitive layer, in such an amount that at a magenta density higher than about 1.0 a black dye is formed during development. This solves the problem of 'red colour blindness'; shadow details in an originally photographed red scene are usually badly reproduced by colour papers when they are image wise exposed through a negative. These shadow details are now better reproduced by the additive effects of the black dye.

In a preferred embodiment the black coupler of the invention is added in a separate black layer, other than the light sensitive layers comprising yellow, magenta or cyan couplers. Such a black layer is preferably located adjacent to a silver halide layer. Said black layer is preferably located closer to the base than other silver halide layers when the light stability of the black dye formed upon development is less than that of the, for example, yellow, magenta and cyan dye formed during development. At high exposed regions in the silver halide layer oxidised developer will diffuse to the adjacent layer to react with the black coupler and form black density. Conventional photographic materials have at least one blue-, at least one green- and at least one red-sensitive layer. The light-sensitive layers are separated from layers sensitised to an other colour by so-called middle layers. These middle layers comprise colourless coupler or couplers whose function it is to intercept oxidised developer, migrating in the lateral direction from one colour layer to another. The resulting effect of these colourless couplers or scavengers is that formation of contaminating dyes in adjacent light sensitive layers sensitised to another colour of light is prevented. In one embodiment the black coupler replaces at least partly the colourless coupler.

In a preferred embodiment the colour photographic material according the invention comprises a black layer, which is a silver halide layer comprising a black coupler yielding black density after colour developer processing. The silver halide in the black layer can be sensitised for one or more colours of light. It is also possible to add more than one silver halide into said black layer, each being sensitised to a different colour of light. For each colour of light the sensitivity of the silver halide in the black layer, sensitive to that colour of light, is lower than the sensitivity of the silver halide sensitised to the same colour in any other layer than said black layer. If there are more silver halides sensitised to a colour of light in other layers than said black layer then the silver halide sensitivity in the black layer is lower than the average sensitivity of said other silver halides.

As stated before, when black dye is formed it should be formed at higher densities so that pure colours of lower density are not contaminated, since that would result in an unacceptable colour reproduction. Normally colour reproduction and colour purity are judged visually. We now provide a method to characterize the black layer(s) as a set of characteristic curves which method can be used as a good approximation to design a black layer.

Characteristic curves for colour papers are so-called D-log E curves in which D (density) is plotted as a function of log E (Exposure amount), and are described in detail in, for example, T. H. James, The Theory of the Photographic Process, $4^{th}$ ed. 1977 Ch. 18, page 501-509.

Point gamma can be obtained by the following equation as defined on page 502 of the above literature:

$$\text{Point gamma} = dD/d \log E$$

and it represents a differentiated value on an arbitrary point on the characteristic curve, the meaning of which is described in R. Lutter, Trans. Faraday Soc., Vol. 19, page 340 (1923).

The black layer is characterized as follows. First, characteristic curves are obtained for each of the blue-, green- and red-light sensitive layer(s) by gradient exposure on an FW type sensitometer produced by Fuji Photo Film Co., Ltd. and subsequently processed and measured as described in EP0816918A1 page 3-4 except that for each of the blue-, green- and red-light sensitive layer the yellow as well as the magenta as well as the cyan densities are plotted in the characteristic curves. This results in a set of characteristic curves for each colour layer. FIG. 1 shows such a set of curves for the green light sensitive layer(s). Besides the normal primary magenta density characteristic curve (designated Gm) distinct secondary yellow- and cyan-density curves are present in a photographic material in which a black coupler is added. (designated Gy and Gc). These represent the black density formed upon green light exposure. Similarly curves By, Bm and Bc can be obtained for blue light sensitive layer(s) and Rc, Ry and Rm for red light sensitive layer(s).

The sensitivity of each curve is defined as the log E value corresponding to the maximum point gamma value. When a characteristic curve has a linear part, the maximum point gamma will be constant across a finite log E interval. In that case the average log E value over that linear part is taken as the sensitivity point.

The sensitivity difference between the primary characteristic curve and the secondary characteristic curve with the highest sensitivity is at least about 5 log E, preferably at least about 7 log E. Preferably the sensitivity difference between the primary characteristic curve and the secondary characteristic curve with the highest sensitivity is not higher than about 40 log E, more preferably not higher than about 30 log E.

The secondary characteristic curves can have different maximum densities (Dmax). The highest Dmax of the secondary curves is from 10% to 80% of the Dmax of the primary curve, preferably 20% to 70% more preferably from 30% to 60%.

The gradation of the secondary curves can easily be optimized by a skilled person. The gradation is preferably similar to that of the primary curve. Preferably the gradation is harder than that of the primary curve. A harder curve means that there is less risk of contamination of pure colours by black colour at densities lower than 1.5.

Embodiments in which a black layer is added without reduction of yellow, magenta and/or cyan coupler amounts typically have an excellent colour reproduction with a very high maximum black density.

A colour photographic material according the invention is a colour negative material, a colour positive material, a reverse colour material. In a preferred embodiment the colour photographic material is a colour negative material coated on a reflective base.

In an other preferred embodiment a colour negative material coated on a reflective base comprises a black layer comprising at least one silver halide sensitised for blue and/or green and/or red light and a black resorcinol coupler according the invention.

In a preferred embodiment the black layer comprises a silver halide sensitised for blue, green and red light. The black layer may also comprise a silver halide sensitised for blue light, a silver halide sensitised for green light and a silver halide sensitised for red light. In this embodiment the increased amount of silver added in the black layer is subtracted from the blue, green and red sensitive yellow, magenta and red coupler containing layers. In practice this is done by reducing the total coated amount of the emulsion layer or layers containing said blue, green and red light sensitive silver halides. Said reduction is approximately equally divided over said blue, green and red sensitive silver halide emulsion layers. Some tuning to obtain an optimal sensitometric curve for each of the blue, green or red light sensitive emulsion layer may be necessary depending on the actual product. This requires a simple series of tests in which the flow of the various light sensitive layers is varied. The reduction can be done so that the photographic material of the invention contains less silver per square meter than the conventional photographic material from which it is derived, resulting in a significant reduction of material costs.

As a result, this preferred embodiment provides an economic colour photographic material which has similar sensitometric characteristics as conventional materials. Typically a material according to this embodiment has a sensitivity difference between the secondary characteristic curve with the highest sensitivity and the primary characteristic curve of about 5 log E to 15 log E, preferably from about 7 log E to 10 log E. The Dmax of the black layer is typically 10 to 50% of the Dmax of the primary characteristic curve, preferably about 20 to 40%.

Color photographic materials comprising a light sensitive black layer comprising a black coupler according the invention are preferably used in a digital scanning exposure system using monochromatic high intensity light, such as a gas laser, a light emitting diode, a semiconductor laser, a second harmonic generation light source (SHG) comprising a combination of non-linearoptical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of a non-linear optical crystal with a semiconductor laser or a solid state laser. In particular, for designing a compact and inexpensive apparatus having a longer life span and high stability, it is preferred to use a semiconductor laser, and at least one of the exposure light sources should be a semiconductor laser.

When such a scanning exposure light source is used, the spectral sensitivity of each light sensitive layer can be appropriately set according to the wavelength of the scanning exposure light sources used. Since oscillation wavelength of a laser can be reduced using a SHG light source comprising a combination of non-linear optical crystal with a solid state laser using a semiconductor laser as an excitation light source or a semiconductor laser, for example, blue, green or red light can be obtained. Lasers can be designed to emit light of any wavelength relevant to the purpose of the invention, from the short wavelength (violet-blue) side of the visible spectrum to the long wavelength (red) side and even beyond into the near-infrared (invisible), the peak positions of the spectral sensitivities of all light sensitive layers can be set without any restriction other than peak overlap in mind. Spectral sensitivity peak overlap should be minimised in order to avoid spectral cross-contamination of colours. In one embodiment the silver halide comprised in the black layer is sensitized in a region outside the spectral sensitivity of the blue, green and red light sensitive layer or layers, for example in the near-infrared. This requires an additional scanning light source, emitting a colour of light that matches the spectral sensitivity of the black layer.

EXAMPLE 1

Light Stability of Aminophenol and Resorcinol Couplers

An oil in water emulsion is prepared by dissolving 41 mmol coupler CS-1, CS-2 (comparative) or S1 (inventive) in 33 cc tributylphosphate and 50 cc ethylacetate. The resulting solution is dispersed in 750 cc of an aqueous 20% gelatine solution containing 8 g/l dodecylbenzenesulphonate.

The oil in water emulsion comprising the black coupler is mixed with a gelatine solution containing a green light sensitized cubic silverchlorobromide emulsion with an average size of about 500 nm and the resulting mixture is coated on a reflective base to an amount of 3.6 mmol/m2 black coupler and 1.3 mmol/m2 silver. A protective layer of 92 g/l pigskin gelatine is simultaneously coated to an amount of 0.8 g/m2 pigskin gelatine. During coating 0.5 mmol/m2 of a triazine hardener is added.

The resulting coating is exposed and processed in a colour developing process as described in EP-A-0 816 918, page 3-5, to yield a black density of about 0.6. The thus coated, exposed and processed samples are then irradiated using an intermittent light-dark cycle. During each light-on period of 228 minutes the samples are exposed to 85 kLux/m2 xenon-light at 40° C. and 24% relative humidity using an Atlas Ci4000 Xenon Wheather-Ometer®. During each dark period of 60 minutes the samples are subjected to a temperature of 27° C. and a relative humidity of 70%. The decrease in density was measured after 2 weeks of continuous intermittent cycles.

Another set of samples was developed, without pre-exposure, and subjected to a constant temperature of 80° C. at a constant relative humidity of 70%. The dark stability was measured as the increase in density after 2 weeks.

Visual densities of the fresh and 2 weeks aged samples were measured with an X-Rite® 310 optical densitometer. Visual density simultaneously measures the yellow, cyan and magenta density in a ratio closely matching the response of the human eye.

| | Light stability (% density decrease) | Dark stability (density increase) | colour *) |
|---|---|---|---|
| CS-1 comparative | 96 | 0.45 magenta | Bluish black |
| CS-2 comparative | 94 | 0.18 grey | magenta-brownish |
| S-1 Inventive | 5 | 0.17 red | neutral black |

*) The colour of the sample before any stability test was started
CS-1

-continued

| | Light stability (% density decrease) | Dark stability (density increase) | colour *) |
|---|---|---|---|

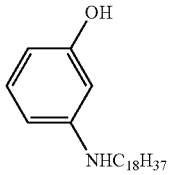

CS-2

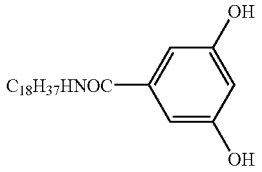

The results show that black couplers according the invention have a superior light stability while maintaining a good dark stability.

The invention claimed is:

1. A colour photographic material comprising a base having a surface, including on the surface thereof a black coupler in combination with one or more color image producing couplers selected from the group consisting of yellow coupler, magenta coupler and cyan coupler, wherein the black coupler is a resorcinol compound that is substituted in at least one of the 2, 4 and 6-positions, and wherein the color image producing couplers produce a color image after exposure and processing in a color developing process.

2. A colour photographic material according to claim 1, wherein said black resorcinol coupler is represented by the general formula (I):

(I)

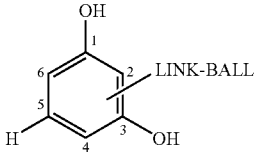

wherein: BALL represents a group which prevents the coupler from diffusing away from the layer containing it; and LINK represents a divalent linking group, which serves to join the resorcinol moiety to the BALL moiety and can be attached to carbon atoms labelled 2, 4 or 6 of the six-membered ring shown in formula (I).

3. A colour photographic material according to claim 1, wherein the black coupler is represented by the general formula (II):

(II)

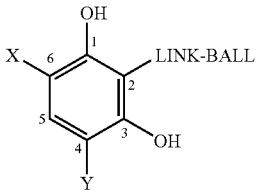

wherein X and Y each represent a hydrogen atom or a group capable of being released upon an oxidative coupling reaction with a developing agent.

4. A colour photographic material according to claim 2, wherein the BALL moiety is selected from:

(a) substituted phenyl, unsubstituted phenyl, substituted naphthyl, and unsubstituted naphthyl groups;

(b) alkyl groups having 3 to 20 carbon atoms; and (c) heterocyclic groups containing a ring system of from 5 to 10 atoms, optionally containing hetero atoms such as oxygen, nitrogen and sulphur.

5. A colour photographic material according to claim 4, wherein the BALL moiety is a substituted or unsubstituted phenyl or naphthyl group.

6. A colour photographic material according to claim 4, wherein the BALL moiety is selected from:

(a) substituted phenyl and naphthyl, wherein the substituent is selected from: hydroxy; halo (such as chloro, bromo and iodo); sulfonyl halide; nitro; cyano; amino; alkyl having from 1 to 20 carbon atoms, optionally substituted; alkoxy having from 1 to 20 carbon atoms; alkylthio having from 1 to 20 carbon atoms; and alkoxycarbonyl having from 1 to 20 carbon atoms.

7. A colour photographic material according to claim 2, wherein the LINK moiety is selected from —COR, —$SO_2$R, —COOR, —NHCOR, —CONHR, —CON(R)$_2$, —$COSO_2$R, —NHCONHR, —$NHSO_2$R and —NHR, R representing the side with which it is connected to the BALL moiety.

8. A colour photographic material according to claim 2, wherein the LINK moiety is —CONHR.

9. A colour photographic material according to claim 1, wherein said black coupler is present in a black colour layer separate from at least one blue light sensitive silver halide layer comprising the yellow coupler, at least one green light sensitive silver halide layer comprising the magenta coupler and at least one red light sensitive silver halide layer comprising the cyan coupler.

10. A colour photographic material according to claim 9 wherein said black colour layer comprises at least one silver halide sensitised for at least one of blue green and/or red light.

11. A colour photographic material according to claim 1, wherein the base is a reflective base.

* * * * *